US007341110B2

(12) United States Patent
Doane et al.

(10) Patent No.: US 7,341,110 B2
(45) Date of Patent: Mar. 11, 2008

(54) SLOTTED SLIP ELEMENT FOR EXPANDABLE PACKER

(75) Inventors: James C. Doane, Friendswood, TX (US); Jason M. Harper, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 275 days.

(21) Appl. No.: 11/118,060

(22) Filed: Apr. 29, 2005

(65) Prior Publication Data

US 2005/0189120 A1 Sep. 1, 2005

Related U.S. Application Data

(63) Continuation-in-part of application No. 10/117,521, filed on Apr. 5, 2002.

(51) Int. Cl.
*E21B 23/01* (2006.01)
*E21B 23/06* (2006.01)

(52) U.S. Cl. ..... 166/387; 166/134; 166/206; 166/382

(58) Field of Classification Search ..... 166/382, 166/380, 387, 134, 212, 207, 206
See application file for complete search history.

(56) References Cited

U.S. PATENT DOCUMENTS

| | | | | |
|---|---|---|---|---|
| 2,373,005 | A | 4/1945 | Baker | 166/122 |
| 3,298,440 | A | 1/1967 | Current | |
| 3,318,385 | A | 5/1967 | Conrad | |
| 5,944,102 | A | 8/1999 | Kilgore et al. | 166/119 |
| 6,056,052 | A | 5/2000 | Mullen et al. | 166/134 |
| 6,378,606 | B1 | 4/2002 | Swor et al. | 166/217 |
| 6,446,717 | B1 * | 9/2002 | White et al. | 166/187 |
| 6,481,497 | B2 | 11/2002 | Swor et al. | 166/134 |
| 6,513,600 | B2 * | 2/2003 | Ross | 166/387 |
| 6,536,520 | B1 | 3/2003 | Snider et al. | 166/78.1 |
| 7,051,805 | B2 * | 5/2006 | Doane et al. | 166/120 |
| 2003/0042028 | A1 * | 3/2003 | Lauritzen et al. | 166/384 |
| 2003/0205386 | A1 * | 11/2003 | Johnston et al. | 166/382 |
| 2003/0213601 | A1 | 11/2003 | Schwendemann et al. | 166/387 |
| 2004/0016545 | A1 * | 1/2004 | Baugh et al. | 166/285 |
| 2004/0256098 | A1 * | 12/2004 | Ducasse et al. | 166/207 |
| 2005/0028989 | A1 | 2/2005 | Doane et al. | 166/380 |
| 2005/0034876 | A1 | 2/2005 | Doane et al. | 166/386 |

* cited by examiner

*Primary Examiner*—Hoang Dang
(74) *Attorney, Agent, or Firm*—Shawn Hunter

(57) ABSTRACT

A packer device includes a central packer mandrel and a radially surrounding expansion mandrel that can expand radially. At least one slip mandrel carrying wickers surrounds the expansion mandrel and a plurality of axial slots are disposed within the slip mandrel.

19 Claims, 2 Drawing Sheets

SLOTTED SLIP ELEMENT FOR EXPANDABLE PACKER

This application is a continuation-in-part of U.S. patent application Ser. No. 10/117,521 filed on Apr. 5, 2002.

BACKGROUND OF THE INVENTION

1. Field of the Invention

The invention relates generally to wellbore packer assemblies and, in particular aspects, to the design of slip devices that are carried upon such packer assemblies.

2. Description of the Related Art

Traditional packers are comprised of an elastomeric sealing element and at least one mechanically set slip. Typically, a setting tool is run in with the packer to set it. The setting can be accomplished hydraulically due to relative movement created by the setting tool when subjected to applied pressure. This relative movement causes the slips to ride up on cones and extend into biting engagement with the surrounding tubular. At the same time, the sealing element is compressed into sealing contact with the surrounding tubular. The set can be held by a body lock ring, which would prevent the reversal of the relative movement that caused the packer to be set in the first instance.

As an alternative to applying pressure through the tubing to the setting tool to cause the packer to set, another alternative was to run the packer in on wire line with a known electrically-operated setting tool, such as an "E-4"-style setting tool that is available commercially from Baker Oil Tools of Houston, Tex. In setting the packer device, a signal fires the E-4 causing the requisite relative movement for setting. If the packer device is of a retrievable type, a retrieving tool could later be run into the set packer and release the grip of the lock ring and allow movement of the slips back down their respective cones and a stretching out of the sealing element so that the packer device can be removed from the well.

Some packer designs seek to create an engagement of packer element slips or wickers by direct radial expansion of an expansion mandrel that carries slips or wickers. Examples of such expandable packer designs are found in a parent application to this one, U.S. Patent Publication No. U.S. 2005/0028989 A1. This Publication describes packer devices that are set by radially expanding an outer expansion mandrel in response to fluid pressure from the flowbore. U.S. Patent Publication No. U.S. 2005/0028989 A1 is owned by the assignee of the present invention and is hereby incorporated by reference.

A problem arises when a separate slip mandrel is placed to radially surround the expansion mandrel. A slip mandrel is generally a unitary tubular component having a substantially smooth radially inner surface and an outer radial surface with engagement wickers integrally formed thereupon. The addition of this unitary component will substantially increase the setting force required to expand the expansion mandrel and urge the wickers into biting engagement with the surrounding tubular.

Placing axial slots in the slip mandrel to make it easier to expand is problematic. Slotting the slip mandrel will necessarily weaken it and possibly render it vulnerable to rupturing during expansion of the expansion mandrel.

U.S. Pat. No. 6,378,606 issued to Swor et al. shows a barrel slip body having axial slots that divide the slip body into a series of separate barrel slip anchors. The slots extend along almost the entire length of the barrel slip body. During setting, wedge cones are axially moved to cam the slip portions of the barrel slip radially outwardly and into a set position. During axial setting, the slip portions move outwardly substantially uniformly along their lengths.

The type of barrel slip described in the Swor patent would be unsuitable for use with a radially expandable packer that uses a radially expandable expansion mandrel to urge the slip mandrel into setting. The forces involved in setting the slip wickers are substantially different with the radially expandable packer than with an axially set one. With the radially expandable packer, the expansion mandrel expands radially outwardly in a manner that is substantially uniform along the axial length of the slip mandrel. However, there may be portions at the axial ends and in the axial center of the expansion mandrel that are intended to expand to a greater degree than the other portions of the expansion mandrel. Thus, a more suitable slip mandrel design is needed for use with radially expandable packer devices.

The present invention addresses the problems of the prior art.

SUMMARY OF THE INVENTION

The invention provides an improved packer device and slip mandrel design that is particularly well suited for use where the packer device has an expansion mandrel that is expanded radially to set the slip mandrel. The exemplary slip mandrel includes a generally tubular mandrel body with an inner radial surface that is shaped and sized to adjoin the outer surface of an expansion mandrel. The outer radial surface of the slip mandrel presents a number of hardened wickers that are shaped and sized to create a biting engagement with a surrounding tubular.

In accordance with the present invention, the slip mandrel body contains a number of axial slots about its perimeter in a pattern that is particularly suited to the expandable packer design. In a currently preferred embodiment, this pattern features axial slots that partially divide the slip mandrel body from either axial end with those beginning proximate the central portion of the expansion mandrel having a greater length than those beginning from the opposite end of the slip mandrel. Preferably, there are two lesser-length axial slots located between each pair of longer axial slots.

In a preferred embodiment, an exemplary packer device includes a central packer mandrel and a radially surrounding expansion mandrel. The expansion mandrel carries two external slip mandrels that are located on either axial side of a fluid sealing element. The fluid sealing element is located upon a central portion of the expansion mandrel, which is expected to experience the greatest amount of radial expansion during setting. The packer device may be set using any of a number of known methods for radially expanding the expansion mandrel so that the engagement profiles of the slips are brought into engagement with the surrounding tubular.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
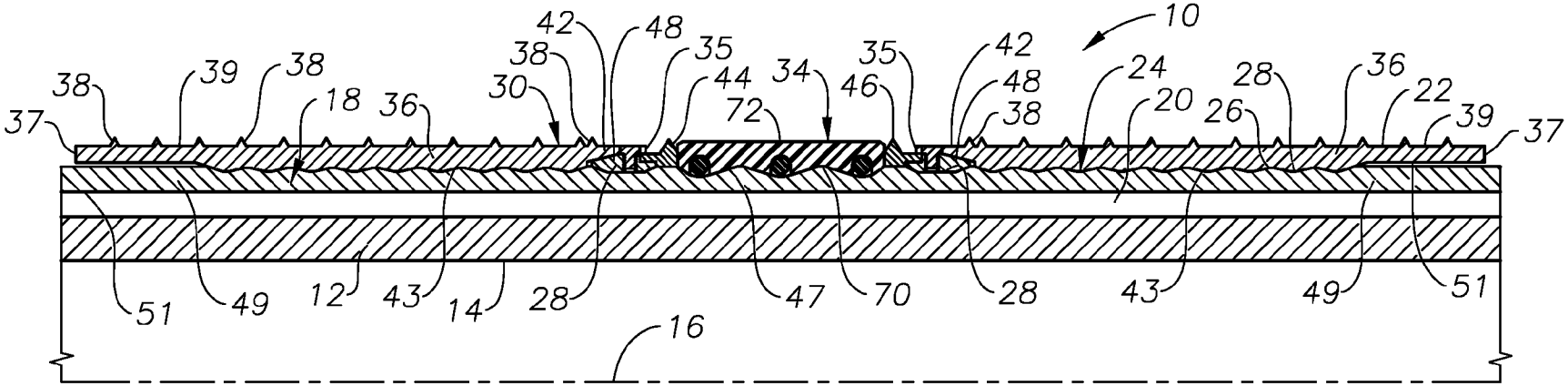
FIG. 1 is a side, one-quarter cross-sectional view of an exemplary packer assembly constructed in accordance with the present invention.
Figure 3:
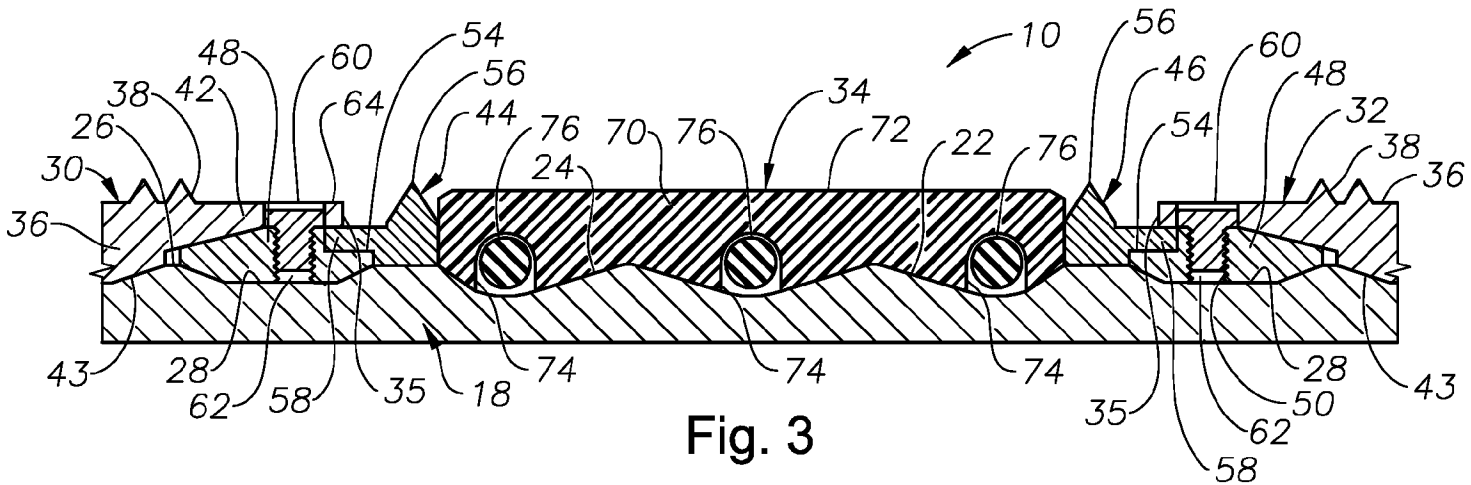
FIG. 3 is an enlarged side, one-quarter cross-sectional view of the fluid seal of the packer assembly and surrounding components.
Figure 2:
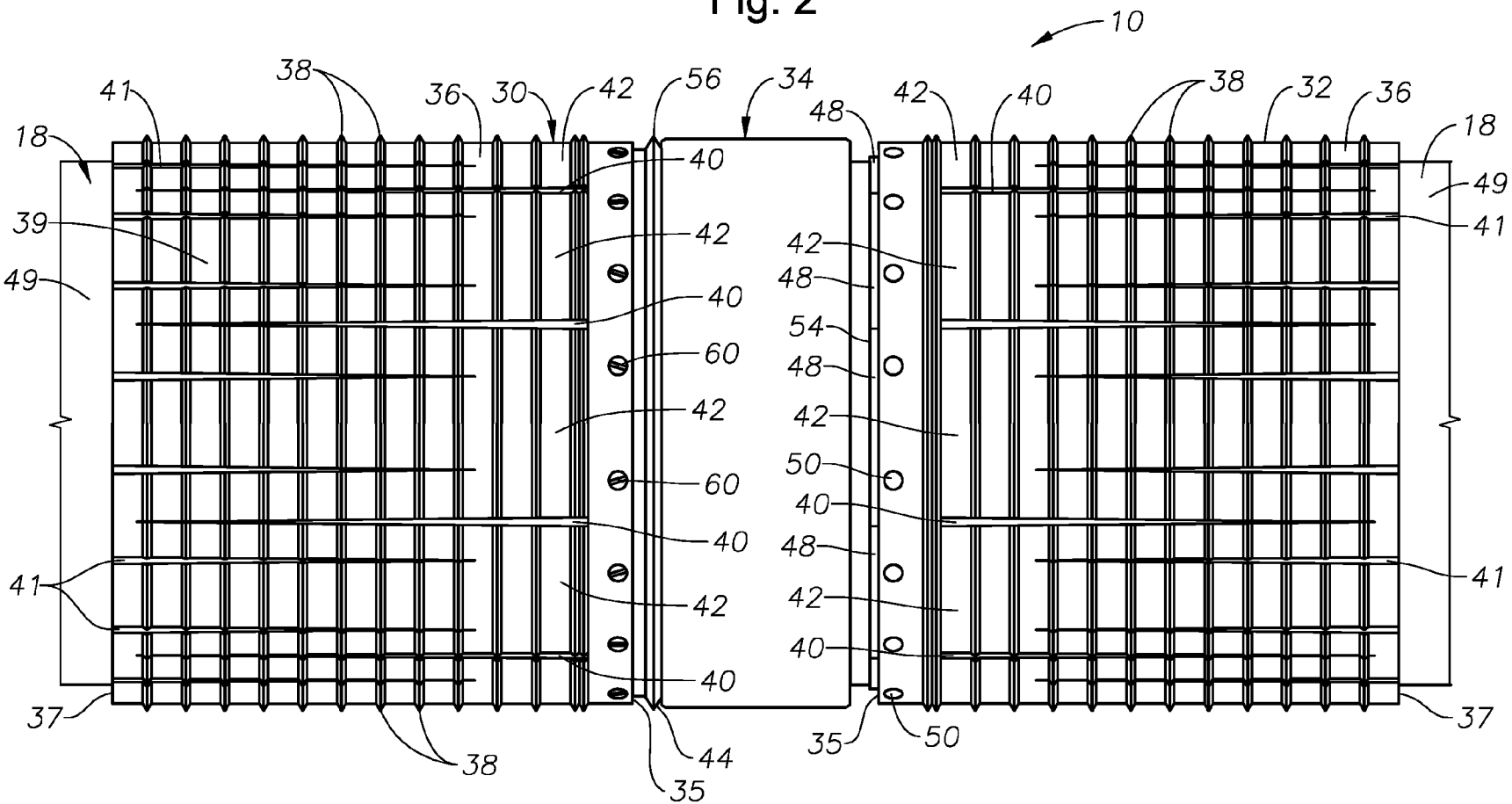
FIG. 2 is an external side view of the packer assembly shown in FIG. 1 and illustrating a slotting pattern in accordance with the present invention.

FIGS. 1-3 depict an exemplary packer assembly 10. As best shown in FIG. 1, the packer assembly 10 has a generally tubular central packer mandrel 12 that defines an axial flowbore 14 along its length. The central axis of the packer mandrel 12 and the packer assembly 10 is shown at 16. The central packer mandrel 12 is preferably formed of a very hard, non-malleable material, such as 4140 steel. Although not depicted in FIG. 1, it will be understood by those of skill in the art that opposite axial ends of the packer mandrel 12 are typically threaded to allow the packer assembly 10 to be incorporated into a string of tubing members and, thereafter, to be disposed within a wellbore for setting.

An expansion mandrel 18 radially surrounds the packer mandrel 12. The expansion mandrel 18 may be formed of 4140 steel also, but is typically of a lesser thickness than the central mandrel 12 so that it can be expanded radially outwardly. A hydraulic pressure chamber 20 is defined between the expansion mandrel 18 and the packer mandrel 12. The outer radial surface 22 of the expansion mandrel 18 presents a corrugated portion 24 wherein a series of gentle annular ridges 26 are separated by troughs 28.

Slip mandrels 30, 32 radially surround the expansion mandrel 18. The slip mandrels 30, 32 are located on either axial side of a fluid seal element 34, which also surrounds the expansion mandrel 18. Each of the slip mandrels 30, 32 includes a slip mandrel body 36 having an inboard axial end 35 and an outboard axial end 37, as well as an outer radial surface 39 that presents a series of radially outwardly protruding wickers 38. The "inboard" axial end 35 is the end of the slip mandrel 30 or 32 that lies proximate the central portion 47 of the expansion mandrel 18 and which is expected to undergo the greatest amount of radial expansion during setting. The "outboard" axial end 37, conversely, will lie furthest away from the central portion 47 and proximate the axial end portions 49 of the expansion mandrel 18. There are radial spaces 51 defined between the axial end portions 39 of the slip mandrels 30, 32 and the axial end portions 49 of the expansion mandrel 18. Additionally, the central portion 47 of the expansion mandrel 18 has a lesser thickness than the axial end portions 49 of the expansion mandrel 18. It is noted that, while essentially the entire expansion mandrel 18 will expand radially during setting, there is some non-uniform expansion due to the presence of the radial spaces 51 and the thinner central portion 47. During expansion, the axial end portions 49 of the expansion mandrel 18 will expand outwardly to a greater degree to fill the radial spaces 51. This additional expansion is desirable as it helps to further axially lock the slip mandrels 30, 32 into position upon the body of the expansion mandrel 18. The thinner central portion 47 will also tend to expand outwardly to a greater degree than neighboring portions of the expansion mandrel 18.

Each slip mandrel body 36 is, as shown by FIG. 2, partially separated angularly by inboard axial slots 40 and outboard axial slots 41 to allow the slip mandrels 30, 32 to expand radially. As best shown in FIG. 3, the inboard slots 40 begin at the inboard axial end 35 and extend to an intermediate point that is located approximately 90-95% along the axial length of the body of the slip mandrel 30 or 32, as measured from the inboard end 35. Due to the separation of the slip mandrels 30, 32 by slots 40, the inboard axial ends 35 of the slip mandrels 30, 32 are divided into arcuate slip sections 42. Outboard slots 41 begin at the outboard end 37 of the body of each slip mandrel 30, 32 and extend approximately ⅔ of the axial length of the body of the slip mandrel 30 or 32, as measured from the outboard end 37. It is currently preferred, as shown in FIG. 3, that there be two of the shorter slots 41 located between each pair of longer slots 40. In testing, this type of slot pattern has proven to be of optimum effectiveness for use with radially expandable packer devices wherein the expansion of the expansion mandrel 18 involves non-uniform expansion forces. During expansion, the outboard slots 41 will be widened due to the additional expansion of the axial end portions 49 of the expansion mandrel 18.

The wickers 38 are shaped and sized so as to provide a substantial biting engagement with a surrounding tubular when the expansion mandrel 18 is radially expanded. The radially inner surface 43 of each slip mandrel 30, 32 is corrugated in a similar manner as the corrugated portion 24 of the expansion mandrel 18 so that the slip mandrels 30, 32 will seat upon the expansion mandrel 18 in a complimentary manner.

Also surrounding the expansion mandrel 18 are annular retaining rings 44, 46, which are preferably located adjacent the fluid sealing element 34. Additionally, a plurality of retainer segments 48 underlie the retaining rings 44, 46. It is noted that, in FIG. 2, one retaining ring 44 is shown installed while the other retaining ring 46 has been removed to provide a better view of the retainer segments 48. Each of the retainer segments 48 is generally rectangular in shape and has a width that approximates the width of the slip sections 42. Additionally, each retainer segment 48 is arcuately curved along its width so that it will lie easily upon the outer surface 22 of the expansion mandrel 18. One or more screw holes 50 is disposed through each of the retainer segments 48. As best seen in FIG. 2, the upper side of each retainer segment 48 presents a sloped surface 52 and an axially protruding ledge 54. The retaining rings 44, 46 each present a sharpened outer edge 56 and a laterally-protruding leg 58.

The slip mandrels 30, 32 are secured in place upon the outer surface 22 of the expansion mandrel 18 by affixing securing screws 60 through screw holes 62 in the slip mandrel sections 42 and into the screw holes 50 of the retaining segments 48. The leg 58 of the retaining rings 44, 46 overlie the ledges 54 of the retainer segments 48. A forward edge portion 64 of the slip sections 42 overlies the leg 58 of the retaining rings 44, 46. Thus, when the screws 60 are tightened into place, the forward edge portion 64 tightens down to some degree upon the leg 58 and the ledges 54. The legs 58 of the retaining rings 44, 46 will keep the retainer segments 48 within the trough 28 by preventing them from moving radially outwardly or axially upon the surface 22 of the expansion mandrel 18. As a result, the slip sections 42 and retainer segments 48 are fixedly secured to the expansion mandrel 18. The retaining rings 44, 46 thus serve the function of helping to hold the slip mandrels 30, 32 in place upon the expansion mandrel 18. This securement, together with the use of the complimentary corrugated surfaces, prevents the slip mandrels 30, 32 from moving axially with respect to the expansion mandrel 18 during running in and during the process of setting the packer assembly 10. It is noted that this securement technique does not require the expansion mandrel 18 to be penetrated by a connector, such as a screw, or to have abrupt changes in the geometry of the expansion mandrel 18, either of which might cause the expansion mandrel 18 to fail during setting. In testing, this securement technique has proven to be quite effective in preventing the slip mandrels 30, 32 from becoming unseated during operation.

The fluid sealing element 34 is specially formed to provide a seal that can be energized into sealing engagement with a surrounding wellbore tubular and, at the same time, is resistant to chemicals within the wellbore and extreme temperatures. The fluid sealing element 34, which is best seen in FIG. 3, includes a seal body 70 with a radially outer sealing surface 72. The seal body 70 is preferably fashioned from a thermoplastic material and preferably a chemically inert thermoplastic that is resistant to degrading in extreme temperatures. Suitable thermoplastic materials for use in forming the seal body 70 are TEFLON® and PEEK. The radially inner side of the seal body 70 contains three separate annular channels 74. Although three channels are shown, there may be more or fewer than three channels 74. Each of the channels 74 houses an elastomeric ring element 76. The presence of the elastomeric ring elements 76 allows the sealing element 34 to be energized into sealing engagement with a surrounding tubular.

In operation to set the packer device 10, fluid pressure is increased within the hydraulic pressure chamber 20 of the packer assembly 10. Typically, this is done by increasing fluid pressure from the surface of the well inside the production tubing string within which the packer device 10 is incorporated. If desired for setting, a ball or plug (not shown) may be dropped into the tubing string to land on a ball seat (not shown) below the packer device 10 within the tubing string. Pressure is then built up behind the ball or plug. Increased pressure within the flowbore 14 of the packer assembly 10 is transmitted into the hydraulic pressure chamber 20 to expand the expansion mandrel 18 radially outwardly and cause the wickers 38 of the slip mandrels 30, 32 to be set into a surrounding tubular. As the expansion mandrel 18 expands radially, it causes a widening of the slots 40 and 41. The sharpened edges 56 of the retaining rings 44, 46 are also set into the surrounding tubular in a biting engagement. The terms "outer tubular" and "surrounding tubular" are used herein to designate generally any surrounding cylindrical surface into which the packer device 10 might be set. Ordinarily, the packer device 10 would be set within a string of steel casing lining the interior of a wellbore. However, a suitably sized packer device 10 could also be set within an inner production tubing string or liner. Alternatively, the "surrounding tubular" might be the uncased surface of a section of open hole within a wellbore.

It is noted that the setting technique described generally above is merely one example of a technique for radially expanding the expansion mandrel 18 into a set position. In fact, any of a number of known methods could be used to cause the expansion mandrel 18 to be radially expanded. For example, a striker module, power charge, or force intensifier, devices of known construction and operation, which are run into the flowbore 16 of the packer device 10 might be used. Numerous setting techniques are described in U.S. Patent Publication No. U.S. 2005/0028989, which is owned by the assignee of the present invention and is herein incorporated by reference.

Those of skill in the art will recognize that numerous modifications and changes may be made to the exemplary designs and embodiments described herein and that the invention is limited only by the claims that follow and any equivalents thereof.

What is claimed is:

1. A packer device for use within a wellbore and comprising:

a central packer mandrel;

an expansion mandrel radially surrounding the central packer mandrel and radially expandable with respect to the central expansion mandrel, the expansion mandrel having a mandrel body that is moveable between a radially reduced unset position and a radially enlarged set position, the expansion mandrel having a central portion and an axial end portion;

a slip mandrel radially surrounding the expansion mandrel and having a set of wickers for forming a biting engagement with a surrounding tubular within the wellbore when the expansion mandrel is in its set position, the slip mandrel having an inboard end that lies proximate the central portion of the expansion mandrel and an outboard end that lies proximate the axial end portion of the expansion mandrel; and a plurality of axial slots disposed within the slip mandrel to allow radial expansion of the slip mandrel during expansion of the expansion mandrel.

2. The packer device of claim 1 wherein the plurality of axial slots comprises a set of inboard axial slots that extends from the inboard end of the slip mandrel to an intermediate point along the body of the slip mandrel.

3. The packer device of claim 2 wherein the intermediate point is located from about 90% to about 95% of the axial length of the slip mandrel, as measured from the inboard end of the slip mandrel.

4. The packer device of claim 2 wherein the plurality of axial slots further comprises a set of outboard axial slots that extends from the outboard end of the slip mandrel to an intermediate point along the body of the slip mandrel.

5. The packer device of claim 4 wherein the outboard axial slots have an axial length that is shorter than that of the inboard axial slots.

6. The packer device of claim 4 wherein:

the axial slots are disposed angularly about the circumference of the slip mandrel; and there are a plurality of outboard axial slots positioned between each two inboard axial slots.

7. The packer device of claim 6 wherein there are two outboard axial slots positioned between each two inboard axial slots.

8. The packer device of claim 5 wherein the outboard axial slots have a length that is approximately ⅔ of the axial length of the slip mandrel.

9. A packer device for use within a wellbore comprising:

a central packer mandrel;

an expansion mandrel radially surrounding the central packer mandrel and radially expandable with respect to the central packer mandrel, the expansion mandrel having a mandrel body that is moveable between a radially reduced unset position and a radially enlarged set position, and further having a central portion and an axial end portion;

a pair of slip mandrels radially surrounding the expansion mandrel, each of the slip mandrels having a set of wickers for forming a biting engagement with a surrounding tubular within the wellbore when the expansion mandrel is in its set position, the slip mandrels further each having an inboard end that lies proximate the central portion of the expansion mandrel and an outboard end that lies proximate the axial end portion of the expansion mandrel; and a plurality of axial slots disposed within each of the slip mandrels to allow radial expansion of the slip mandrels during expansion of the expansion mandrel.

10. The packer device of claim 9 wherein the plurality of axial slots comprises a set of inboard axial slots that extends from the inboard end of the slip mandrels to an intermediate point along the body of the slip mandrels.

11. The packer device of claim 10 wherein the intermediate point is located from about 90% to about 95% of the axial length of the slip mandrel, as measured from the inboard end of the slip mandrel.

12. The packer device of claim 9 further comprising a fluid sealing element radially surrounding the expansion mandrel proximate the central portion of the expansion mandrel.

13. The packer device of claim 10 wherein the plurality of axial slots further comprises a set of outboard axial slots that extends from the outboard end of the slip mandrel to an intermediate point along the body of the slip mandrel.

14. The packer device of claim 13 wherein the outboard axial slots have an axial length that is shorter than that of the inboard axial slots.

15. The packer device of claim 13 wherein:

the axial slots are disposed angularly about the circumference of the slip mandrel; and there are a plurality of outboard axial slots positioned between each two inboard axial slots.

16. The packer device of claim 15 wherein there are two outboard axial slots positioned between each two inboard axial slots.

17. The packer device of claim 15 wherein the outboard axial slots have a length that is approximately ⅔ of the axial length of the slip mandrel.

18. A method of providing a sealing engagement within a wellbore comprising the steps of:

providing a plurality of axial slots in a slip mandrel to allow the slip mandrel to expand radially, the slip mandrel having wickers for forming a biting engagement with a surrounding tubular;

disposing the slip mandrel radially about a packer device expansion mandrel and a central packer mandrel, the expansion mandrel being moveable with respect to the central packer mandrel between a radially reduced unset position and a radially expanded set position; and radially expanding the expansion mandrel with respect to the central packer mandrel to urge the slip mandrel into biting engagement with a surrounding tubular.

19. The method of claim 18 wherein the step of providing a plurality of axial slots in the slip mandrel comprises disposing axial slots that extend from an inboard end of the slip mandrel.

* * * * *